US005358130A

United States Patent [19]

Mengeu et al.

[11] Patent Number: 5,358,130

[45] Date of Patent: Oct. 25, 1994

[54] ONE-PIECE CONTAINER CLOSURE WITH LID HELD OPEN FOR DISPENSING

[75] Inventors: Gary L. Mengeu, Wheeling, W. Va.; Herbert V. Dutt, Sarasota, Fla.

[73] Assignee: Continental Plastics, Inc., Triadelphia, W. Va.

[21] Appl. No.: 233,080

[22] Filed: Apr. 26, 1994

[51] Int. Cl.[5] ..... B65D 47/00

[52] U.S. Cl. ..... 215/238; 215/235; 215/237; 222/517; 222/546

[58] Field of Search ..... 215/235, 237, 238, 346; 220/339; 222/153, 517, 545, 546, 556

[56] References Cited

U.S. PATENT DOCUMENTS

| | | | |
|---|---|---|---|
| 3,059,816 | 10/1962 | Goldstein | 222/109 |
| 3,131,824 | 5/1964 | Van Baarn | 215/4 |
| 3,752,371 | 8/1973 | Susuki et al. | 222/182 |
| 4,010,875 | 3/1977 | Babiol | 222/517 |
| 4,127,221 | 11/1978 | Vere | 222/153 |
| 4,158,902 | 6/1979 | Chernack et al. | 16/150 |
| 4,193,519 | 3/1980 | Dubach et al. | 222/111 |
| 4,220,248 | 9/1980 | Wilson et al. | 215/235 |
| 4,261,486 | 4/1981 | Bush et al. | 222/517 |
| 4,399,928 | 8/1983 | Klingler | 220/335 |
| 4,625,898 | 12/1986 | Hazard | 222/517 |
| 4,917,253 | 4/1990 | Dutt | 215/235 |
| 4,993,606 | 2/1991 | Bolen, Jr. et al. | 222/546 |

FOREIGN PATENT DOCUMENTS

| | | |
|---|---|---|
| 2658805 | 12/1976 | Fed. Rep. of Germany . |
| 2407140 | 10/1977 | France . |

*Primary Examiner*—Stephen P. Garbe
*Assistant Examiner*—Nova Stucker
*Attorney, Agent, or Firm*—Richard V. Westerhoff

[57] ABSTRACT

A one-piece closure for dispensing product from a container has a cap secured to the container and a lid connected to the cap by a support arm through an integrally molded hinge. The support arm is pivoted by the hinge between a pair of upstanding projections on the end wall of the cap. Ribs projecting laterally from the support arm engage the projections to maintain the lid opened when the container is inverted to dispense product. When the lid is pushed closed, the ribs deform to allow the support arm to pass between the projections. In one embodiment, side edges of the ribs engage upwardly facing cylindrical camming surfaces on the projections. In another embodiment, the outer surfaces of the ribs engage confronting flat surfaces on the two projections. In the closed position of the lid, the ribs in both embodiments are received in recesses in the projections so that they do not become permanently deformed and loose their effectiveness over time.

15 Claims, 5 Drawing Sheets

ONE-PIECE CONTAINER CLOSURE WITH LID HELD OPEN FOR DISPENSING

BACKGROUND OF THE INVENTION

1. Field of the Invention

This invention relates to a container closure with a lid which closes off a dispensing opening when not in use. More particularly, it relates to such a closure having elements which retain the lid in an open position when the container is turned over to dispense the contents.

2. Background of Information

Many types of liquid products with a wide range of viscosities, and granular or powder products, are sold in containers with dispensing closures through which the product is discharged by inverting and often by shaking and/or squeezing the container. Today, most of these closures are molded from plastic resins of various kinds. Typically, the closure is provided with a hinged lid, often integrally molded with the closure body, for closing the dispensing opening. Usually, the lid has a plug which serves as a stopper for the dispensing opening.

Various arrangements have been proposed for holding the hinged lid of these closures open to preclude interference with the product stream when the container is turned over, and in some cases, shaken. Some of these arrangements are quite intricate and costly to manufacture requiring molds with slides and/or inserts. Other, while effective, do not present a pleasing appearance. In some, the elements which hold the lid open are compressed when the lid is closed. These elements tend to lose their memory when compressed over an extended period of time, and thus become less effective.

Many of the products packaged in containers with dispensing closures are hot packed, and must be cooled down with a water flush after packaging. Existing dispensing closures allow the cooling water to enter the container or trap water within the closure.

There is a need for an improved dispensing closure with a lid which is held opening during dispensing and which is simple, easy and economical to manufacture, presents a pleasing appearance and does not lose its effectiveness over time.

There is also a need for such an improved dispensing closure which seals out the cooling water spray used for product cool down.

SUMMARY OF THE INVENTION

These needs and others are satisfied by the invention which is directed to a one-piece container closure comprising a cap having a planar end wall with a dispensing opening in it and a side wall with means for securing the cap to the container. A pair of projections extend upward from the planar end wall of the cap adjacent an edge thereof and are spaced apart equally on each side of a diameter of the end wall passing through the dispensing opening. The closure further includes a planar lid configured to cover the planar end wall, except for the projections, when closed, A plug depending from the planar lid engages the dispensing opening when the lid is closed. A support arm attached to the planar lid extends between the projections when the lid is closed. An integral hinge pivotally connected to the support arm and to the edge of the planar end wall of the cap between the projections permits rotation of the lid about the hinge axis between a closed position and an opened position. Elongated ribs projecting laterally from the support arm are dimensioned to engage the projections and maintain the lid in the open position. These ribs deform when the lid is moved toward the closed position to allow the support arm to pass between the projections. The projections have recesses in which the ribs are received without engaging the projections when the lid is in the closed position.

As another aspect of the invention, the dispensing opening plugged by the plug on the lid is surrounded by a water tight seal when the lid is closed to prevent penetration of water into the dispensing opening during cool down procedures. The seal includes a continuous groove on one of the end wall of the closure and the lid, and a continuous confronting tongue on the other. This tongue and groove seal completely surrounds the dispensing opening.

Preferably, the ribs on the support arms extends longitudinally generally perpendicular to the planar lid. They may extend beyond the support arm, so that they engage the projections and hold the lid open wider than without the longitudinal extensions.

In one embodiment of the invention, the projections have convex camming surfaces extending generally parallel to the pivot axis of the hinge. These camming surfaces are engaged by the side edges of the elongated ribs to provide resistance as the lid is closed. Preferably, these camming surfaces are cylindrical with the radius of curvature centered substantially on the pivot axis of the hinge. In this arrangement, the ribs are tangent to a radius centered on the pivot axis of the hinge which is slightly less than the radius of the curvature of the generally cylindrical camming surfaces to generate the desired interference. Adjacent the cylindrical camming surfaces are guide surfaces having a smaller radius of curvature and which lead into the aforementioned recesses in the form of grooves in which the ribs are received without engaging the projections when the lid is closed.

In another embodiment of the invention, the two projections have confronting side surfaces, and the ribs on the support arm engage the confronting side surfaces of the projections as the lid rotates between the open and closed positions. Preferably again, the ribs extend generally perpendicular to the planar lid and the recesses in the projections in which the ribs are seated when the lid is closed are grooves in the confronting side surfaces extending generally perpendicular to the planar end wall of the cap.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENT

Figure 1:
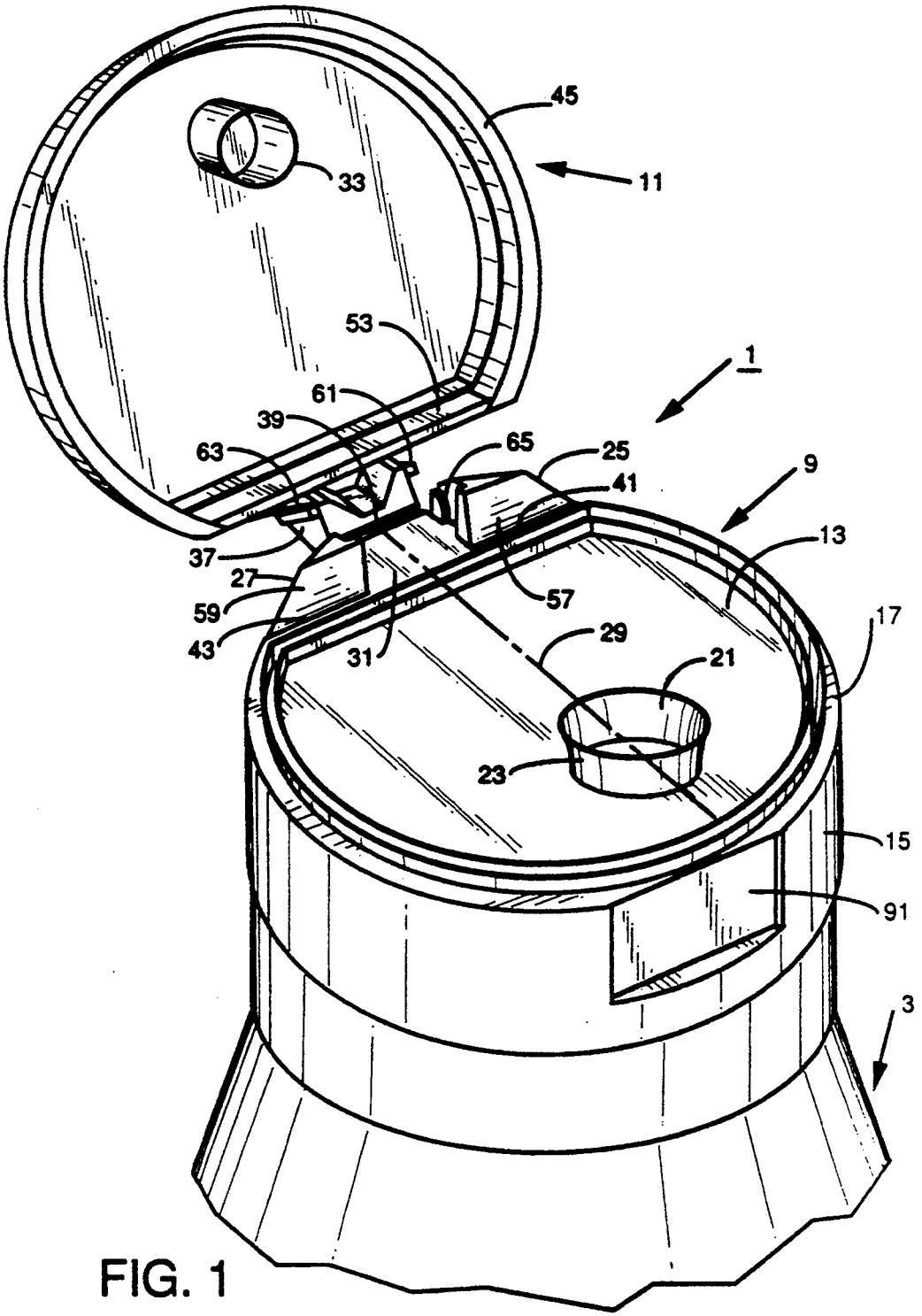
FIG. 1 is an isometric view of a closure in accordance with the invention mounted on a container and shown in the open position.

FIG. 1 illustrates a closure I in accordance with the invention secured to a container 3. As can be seen from FIG. 3, the container 3 has a neck 5 with external threads 7 for securing the closure 1 to the container.

Figure 2:
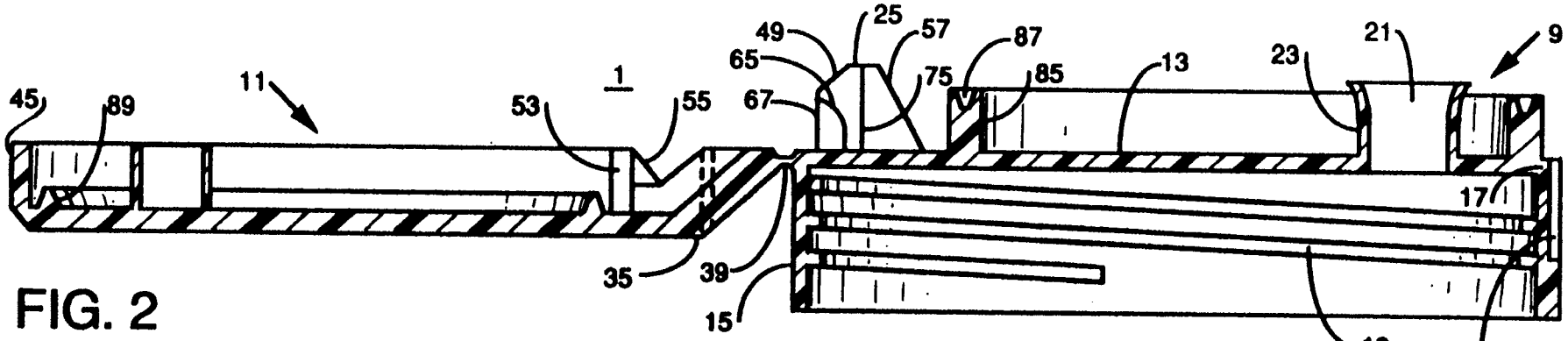
FIG. 2 is a longitudinal section through the closure of FIG. 1 shown in the position in which it is molded.
Figure 5:
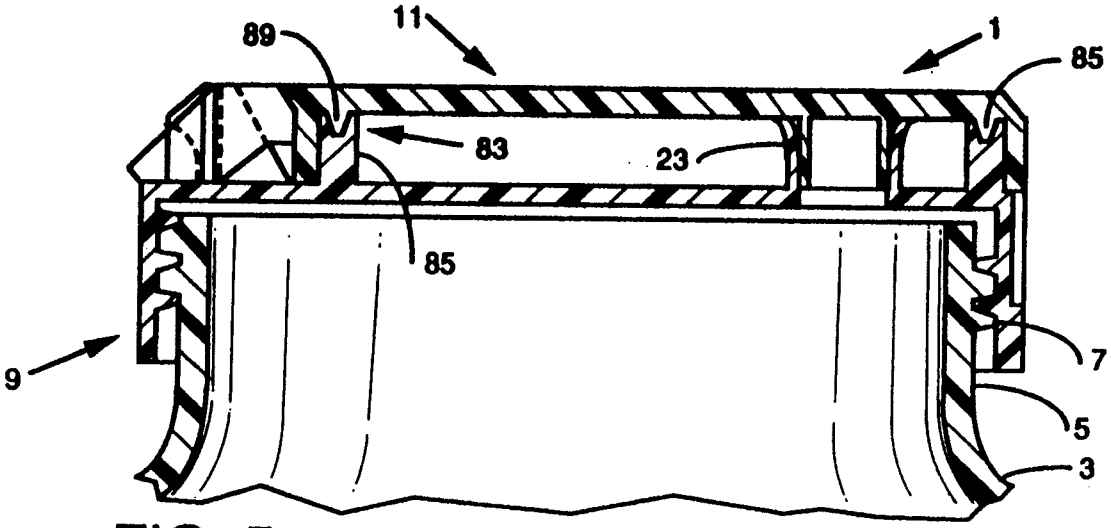
FIG. 5 is a vertical section through the closure of FIGS. 1–4 shown in the closed position on a container.

Referring also to FIG. 2, it can be seen that the closure 1 includes a cap 9 with a lid 11 integrally molded in one piece. The cap 9 has a generally planar end wall 13 and a cylindrical side wall 15 extending axially from the periphery 17 of the end wall. The side wall 15 has internal threads 19 which engage the threads 7 to secure the closure 1 to the container 3. As is well known, other arrangements for securing the closure to the container 3 can be utilized.

The end wall 13 of the closure 1 has a dispensing opening 21 defined by a flared spout 23 which projects upward from the end wall 13.

A pair of projections 25 and 27 extend upward from the end wall 13 along the peripheral edge 17. These projections 25 and 27 are equally spaced on either side of a diameter 29 of the end wall which passes through the dispensing opening 21 to form a gap 31.

The lid 11 is a planar member configured to cover the end wall 13 of the cap, except for the projections 25 and 27, when the lid is closed. A plug 33 on the underside of the lid 11 engages the flared spout 23 when the lid 11 is closed to form a stopper for the dispensing opening 21. The lid 11 has a straight rear edge 35 which forms a chord of the generally circular configuration of the lid perpendicular to the diameter 29. A support arm 37 extends from the center of this rear edge 35 and is joined to the cap 9 at the peripheral edge 19 between the projections 25 and 27 by an integrally formed hinge 39. When the lid 11 is rotated about the integral hinge 39, the support arm 37 enters the gap 31 between the projections 25 and 27. When the lid is fully closed, the rear edge 35 of the lid lays along the front edges 41 and 43 of the projections 25 and 27 respectively. The top peripheral edge of lid has a cylindrical skin 45 which seats on the end wall 13 of the cap when the lid is closed. The top peripheral edge of the lid 11 is beveled at 47. The outer edges of the projections 25 and 27 are similarly beveled at 49 and 51 to provide a continuous beveled surface when the lid is closed. A straight vertical wall 53 spaced inward from the rear edge 35 of the lid adjoins the skirt 45 at each end. The skirt 45 is cut on a bias 55 to provide clearance over the projections 25 and 27. The front surfaces 57 and 59 of the projections 25 and 27 are inclined at a complimentary angle to meet with the biased edges 55 of the skirt 45 when the lid is closed.

Figure 3A:
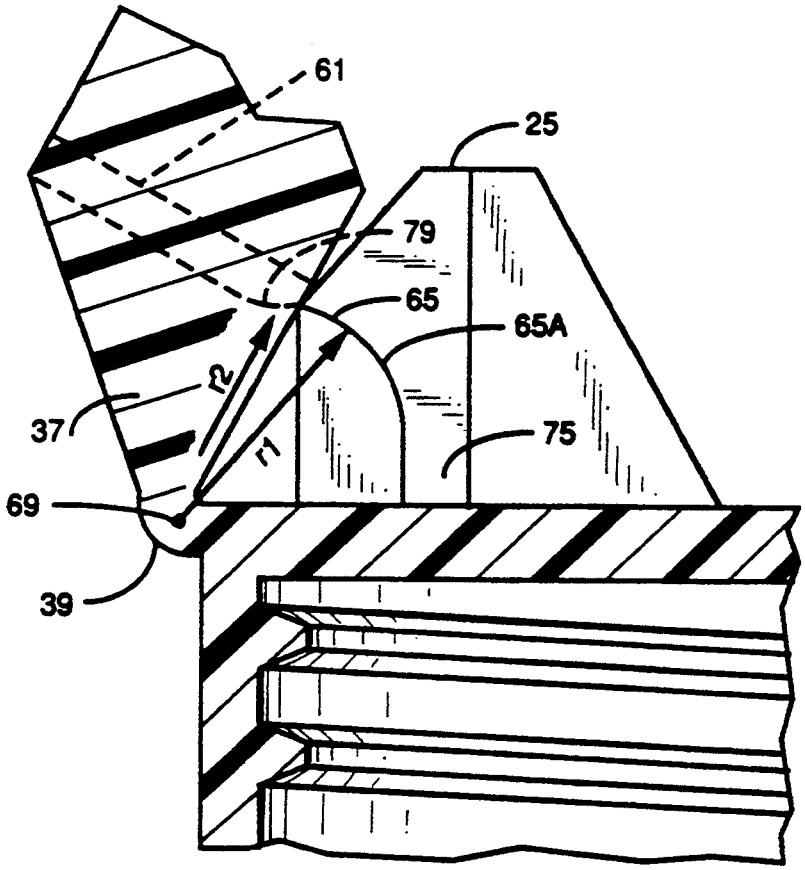
FIG. 3A is a fragmentary vertical section of the closure of FIGS. 1 and 2 showing the lid in full open position.
Figure 3B:
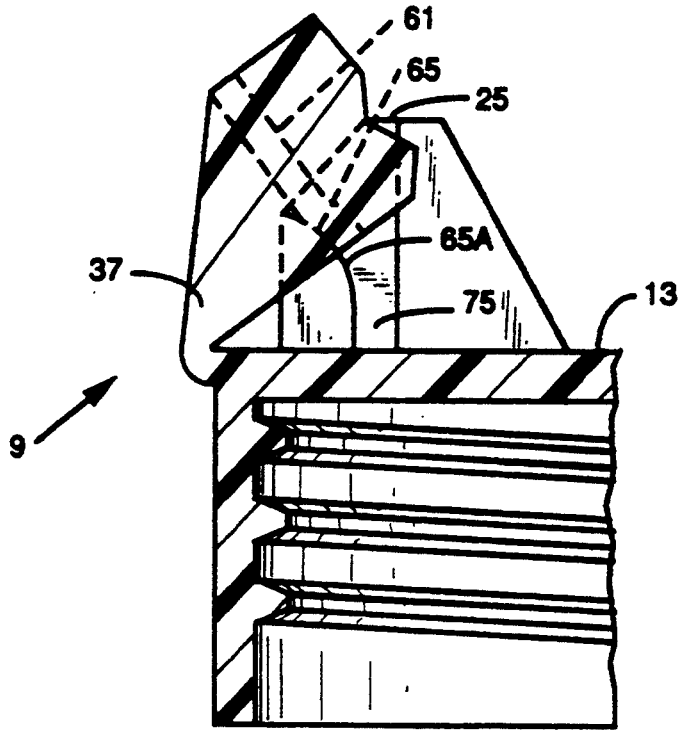
FIG. 3B is a view similar to FIG. 3A showing the lid partially closed.
Figure 4:
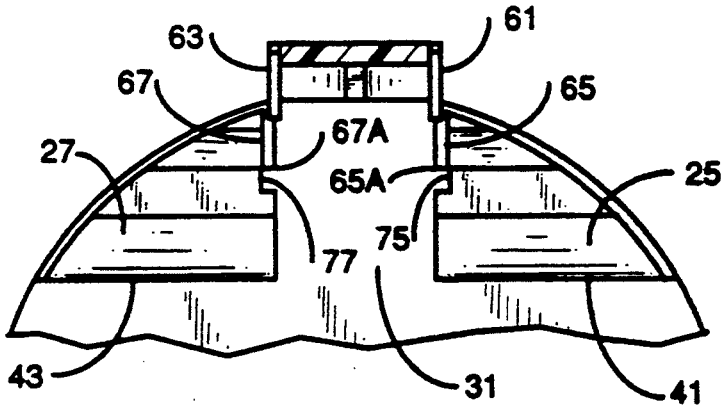
FIG. 4 is a fragmentary top view showing the lid held in the open position.

In order to maintain the lid 11 in an opened position when the container is inverted, and perhaps even shaken, to dispense the container contents, a pair of ribs 61 and 63 project laterally from the sides of the support arm 37. These ribs 61 and 63 extend longitudinally generally perpendicular to the planar lid 11. The projections 25 and 27 have upwardly convex camming surfaces 65 and 67 respectively as best seen in FIGS. 3A and 3B. These upwardly convex camming surfaces are generally cylindrical with a radius of curvature $r_1$ which is centered on the pivot axis 69 of the hinge 39. The ribs 61 and 63 are tangent to a radius $r_2$ centered on the pivot axis 69. The radius $r_2$ is slightly smaller than the radius $r_1$ of the camming surfaces 65 and 67 so that there is interference between the side surfaces 72 and 74 on the ribs 61 and 63 and the camming surfaces 65 and 67.

With the lid 11 fully open, the ribs 61 and 63 prevent the lid from closing when the container is turned upside-down. As the lid is manually closed, the side surfaces 72 and 74 on the ribs 61 and 63 engage the camming surfaces 65 and 67 respectively, thereby deforming the ribs slightly. Inner guide portions 65A and 67A of the camming surfaces 65 and 67 have a shorter radius leading into relieved area or grooves 75 and 77. When the lid 11 is fully closed on the cap 9, the ribs 61 and 63 are received in the relieved area or grooves 75 and 77. The ribs 61 and 63, and the grooves 75 and 77 are dimensioned so that the ribs do not engage the walls of the grooves and hence are not deformed when the lid is closed. Thus, the ribs 61 and 63 are only deformed while the lid 11 is passing between the opened and closed positions, and not while it is in either of the opened or closed positions. This is an improvement over any of the prior art closures wherein the elements which maintain the lid in the open position remain deformed when the lid is closed so that they set to their deformed configuration and loose their effectiveness. The ribs 61 and 63 are beveled at 79 and 81 to provide leads for entering into the gap 31 between the projections 25 and 27.

In order to prevent water from entering the container or pooling in the closure 1, a water tight seal 83 is provided around the dispensing opening. This water tight seal includes a continuous raised wall 85 on the end wall 13 encircling the dispensing spout 23. A groove 87 in the top of the raised wall 85 mates with a continuous tongue 89 projecting downward from the underside of the lid 11. This continuous seal 83 not only prevents the water from getting into the dispensing opening, but also prevents water from pooling on top of the closure.

FIG. 2 illustrates the closure 1 in the position in which it is molded with the lid 11 fully opened. The closure 1 may be molded in this position using a straight draw mold without any slides or cores as there are no undercuts and all of the surfaces are either vertical or relieved. The side wall 15 of the cap 9 has a flattened surface 91 centered on the diameter 29 to provide access under the front edge of the skirt 45 for engaging and lifting the lid from the closed position.

Figure 6:
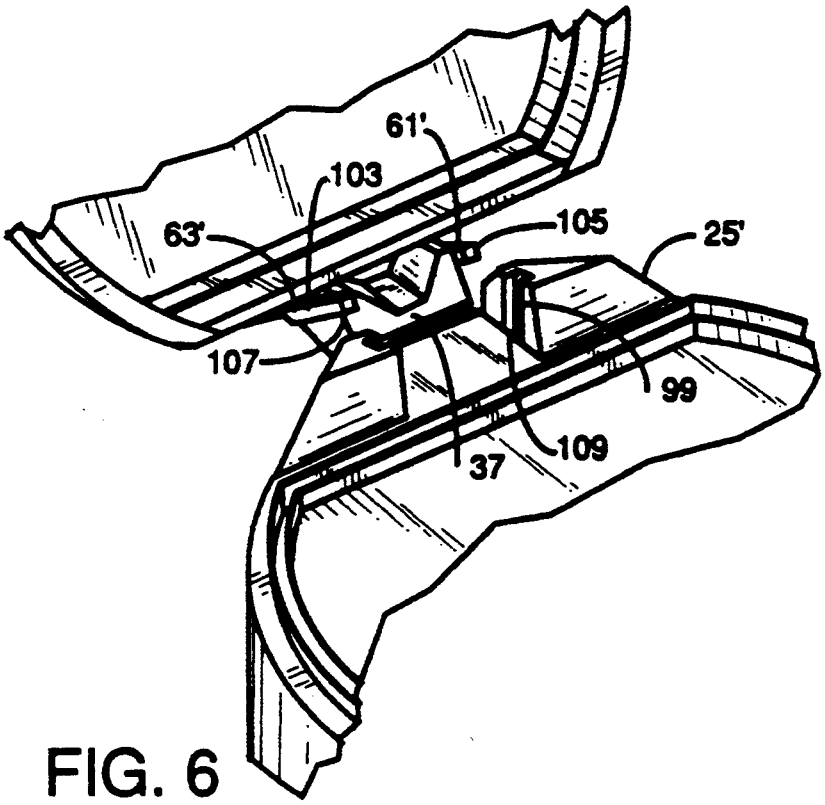
FIG. 6 is a fragmentary isometric view of the hinge area of a second embodiment of the invention.
Figure 7:
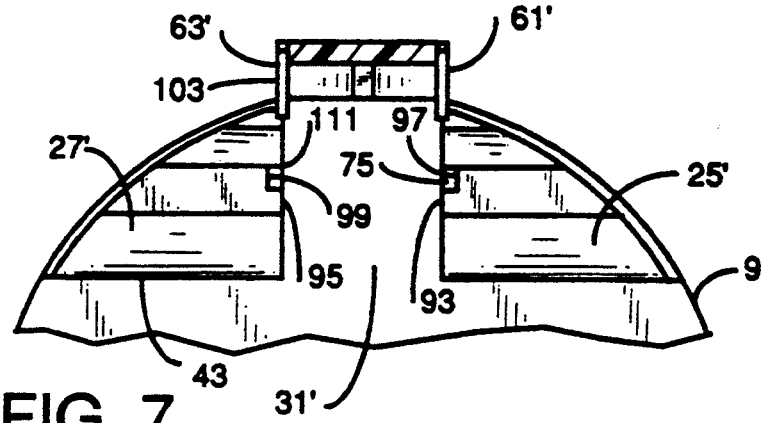
FIG. 7 is a fragmentary top plan view of the embodiment of FIG. 6 shown with the lid open.
Figure 8:
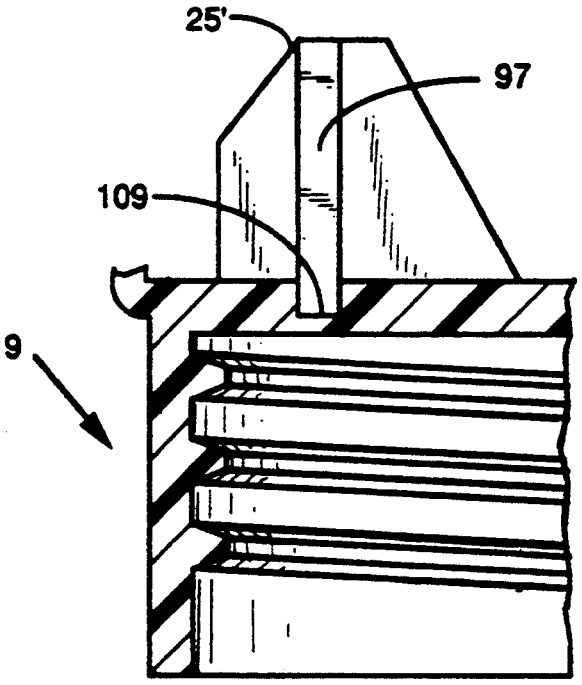
FIG. 8 is a fragmentary vertical section through part of the closure of FIGS. 6 and 7.

FIGS. 6–8 illustrate another embodiment of the invention. Like elements of the closures of the two embodiments are given the same reference numerals. Elements which have been modified somewhat are given primed reference characters. In this second embodiment of the invention, the projection 25′ and 27′ on the end wall 13 of the cap 9 have flat confronting surfaces 93 and 95. These surfaces have confronting vertical grooves 97 and 99. The outer surfaces 101 and 103 of the ribs 61′ and 63′ engage the flat vertical surfaces 93 and 95 respectively as the lid 11 is moved from the open to the closed position. When the lid is closed, the ribs 61′ and 63′ are received in the grooves 97 and 99 respectively. Again, the ribs 61′ and 63′ do not engage the walls of these grooves so that they do not remain deformed while the lid 11 is closed. The ribs 61′ and 63′ have longitudinal extensions 105 and 107 which extend beyond the edge of the support arm 37. These extensions 105 and 107 hold the lid in a slightly more open position and deflect inward to lead the ribs 61' and 63' into the gap 31'. These extensions 105 and 107 are received in indentations 109 and 111 in the end wall 13 of the cap 9 under the grooves 97 and 99. Similar extensions could be provided on the ribs 61 and 63 in the embodiment of the closure shown in FIGS. 1–3. Recesses would also be required in the end wall 13 of the cap 9 to accommodate for these extensions when the lid 11 is closed. On the other hand, the ribs 61' and 63' in the embodiment of FIGS. 6–8 can terminate at the edge of the support arm 37, in which case the indentations 109 and 111 would not be necessary.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended, and any and all equivalents thereof.

What is claimed is:

1. A one-piece closure for a container comprising:

a cap having a planar end wall, a side wall extending axially from said end wall, means on said side wall for securing said cap to the container, a dispensing opening extending through said end wall; and a pair of projections projecting upward from said planar end wall adjacent an edge of said end wall and spaced apart equally on each side of a diameter of said end wall passing through said dispensing opening;

a planar lid configured to cover said planar end wall except for said projections when closed;

a plug depending from said planar lid for plugging said dispensing opening when said lid is closed;

a support arm attached to said planar lid and extending between said projections when said lid is closed;

an integral hinge pivotally connecting said support arm to said edge of said planar end wall of said cap between said projections for rotation of said lid about a pivot axis between said closed position and an open position; and elongated ribs projecting laterally from said support arm and dimensioned to engage said projections and maintain said lid in said open position, said ribs deforming when said lid is moved toward the closed position to allow said support arm to pass between said projections, said projections having recesses in which said ribs are received without engaging said projections when said lid is in said closed position.

2. The closure of claim 1 wherein one of said planar lid and said planar end wall of said cap has a continuous groove forming a closed loop and the other has a continuous confronting tongue which engages said continuous groove when said lid is closed to form a water tight seal surrounding said dispensing opening engaged by said plug.

3. The closure of claim 1 wherein said planar lid has a cylindrical skirt extending axially from a peripheral edge of said planar lid, said skirt seating on said planar end wall of said cap when said lid is closed, and wherein said projections extend upward from said planar end wall of said cap to form with said planar lid a continuous upper surface of said closure when said planar lid is closed.

4. The closure of claim 3 wherein said peripheral edge of said planar lid is bevelled and said projections are similarly bevelled to form a continuous bevel when said lid is closed.

5. The closure of claim 1 wherein said ribs extend longitudinally generally perpendicular to said planar lid.

6. The closure of claim 1 wherein said projections have a convex camming surfaces extending generally parallel to said pivot axis of said hinge and are engaged by said edges of said elongated ribs extending laterally from said support arm.

7. The closure of claim 6 wherein said elongated ribs have bevelled ends which engage said projections when said lid is in said open position.

8. The closure of claim 6 wherein said convex camming surfaces are generally cylindrical and have a radius of curvature centered substantially on said pivot axis of said hinge.

9. The closure of claim 8 wherein said ribs extend longitudinally generally perpendicular to said planar lid and are tangent to a radius centered on said pivot axis which is slightly smaller than said radius of curvature of said generally cylindrical camming surfaces.

10. The closure of claim 9 wherein said elongated ribs have extensions extending longitudinally beyond said support arm to engage said projections before said support arm passes between said projections to hold said lid in said open position, said planar end wall having indentations in which said extensions are received without engaging said end wall when said lid is in said closed position.

11. The closure of claim 1 wherein said pair of projections have confronting side surfaces and said ribs on said support arm engage said confronting side surfaces as said lid rotates between said open end closed positions.

12. The closure of claim 11 wherein said ribs extend generally perpendicular to said planar lid and said recesses in said projections comprise grooves in said confronting side surfaces extending generally perpendicular to said planar end wall of said base member.

13. The closure of claim 12 wherein said ribs have extensions extending longitudinally beyond said support arm to engage said projections before said support arm passes between said projections to hold said lid in said open position, said planar end wail having indentations in which said extensions are received without engaging said end wall when said lid is in said closed position.

14. A one-piece closure for a container comprising:

a cap having a planar end wall, a side wall extending axially from said end wall, means on said side wall for securing said cap to the container, a dispensing opening extending through said end wall, and a pair of projections projecting upward from said planar end wall adjacent an edge of said end wall and spaced apart equally on each side of a diameter of said end wall passing through said dispensing opening, said projections having upwardly facing convex camming surfaces;

a planar lid configured to cover at least a portion of said planar end wall including said dispensing opening;

a support arm attached to said planar lid and extending between said projections when said lid is closed;

an integral hinge pivotally connecting said support arm to said edge of said planar end wall of said cap between said projections for rotation of said lid about a pivot axis between said closed position and an open position; and elongated ribs projecting laterally from said support arm and dimensioned to engage said upwarding facing camming surfaces on said projections and maintain said lid in said open position, said ribs deforming when said lid is moved toward the closed position to allow said support arm to pass between said projections.

15. The closure of claim 14 is wherein said camming surfaces are generally cylindrical and have a radius of curvature centered substantially on said pivot axis of said hinge, and wherein said ribs extend longitudinally substantially perpendicular to said planar lid and are tangent to a radius centered on said pivot axis which is slightly smaller than said radius of curvature of said generally cylindrical camming surface.

* * * * *